US010967537B2

(12) United States Patent
Wiker et al.

(10) Patent No.: US 10,967,537 B2
(45) Date of Patent: Apr. 6, 2021

(54) CIRCULAR SAW, IN PARTICULAR HAND-HELD CIRCULAR SAW

(71) Applicant: Robert Bosch GmbH, Stuttgart (DE)

(72) Inventors: Juergen Wiker, Stuttgart (DE); Thomas Ziegler, Steinheim an der Murr (DE); Michael Wall, Stuttgart (DE); Daniel Dennis, Nuertingen (DE); Torsten Riek, Leinfelden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/479,498

(22) PCT Filed: Jan. 10, 2018

(86) PCT No.: PCT/EP2018/050494
§ 371 (c)(1),
(2) Date: Jul. 19, 2019

(87) PCT Pub. No.: WO2018/141512
PCT Pub. Date: Aug. 9, 2018

(65) Prior Publication Data

US 2019/0381688 A1 Dec. 19, 2019

(30) Foreign Application Priority Data

Jan. 31, 2017 (DE) ..... 10 2017 201 493.8

(51) Int. Cl.
*B27G 19/04* (2006.01)
*B27B 5/38* (2006.01)
*B27B 9/02* (2006.01)

(52) U.S. Cl.
CPC ..... *B27G 19/04* (2013.01); *B27B 5/38* (2013.01); *B27B 9/02* (2013.01)

(58) Field of Classification Search
CPC ..... B27G 19/08; B27G 19/04; B27B 9/02; B27B 5/38
(Continued)

(56) References Cited

U.S. PATENT DOCUMENTS 1,711,490 A 5/1929 Drummond
1,900,553 A * 3/1933 Hampton ..... B23D 47/126 30/391
(Continued)

FOREIGN PATENT DOCUMENTS

DE 33 15 169 A1 11/1983
DE 195 01 579 A1 7/1996
(Continued)

OTHER PUBLICATIONS

International Search Report corresponding to PCT Application No. PCT/EP2018/050494, dated Feb. 9, 2018 (German and English language document) (7 pages).

*Primary Examiner* — Hwei-Siu C Payer
(74) *Attorney, Agent, or Firm* — Maginot, Moore & Beck LLP

(57) ABSTRACT

The disclosure relates to a circular saw, in particular a hand-held circular saw, having a housing and a drive unit, at least some sections of which are arranged in the housing and with which a tool holder for an exchangeable saw blade is associated. The drive unit is designed to rotationally drive the exchangeable saw blade about an associated axis of rotation. In the circular saw, a blade guard is associated with the exchangeable saw blade. The blade guard is mounted in the housing for rotation about the associated axis of rotation and extends around a cutting point of the exchangeable saw blade at least during a sawing operation in such a way that contact with the cutting point can be at least substantially prevented.

14 Claims, 6 Drawing Sheets

(58) Field of Classification Search
USPC ..... 30/377, 388–391
See application file for complete search history.

(56) References Cited

U.S. PATENT DOCUMENTS

| | | | | | |
|---|---|---|---|---|---|
| 2,722,246 | A * | 11/1955 | Arnoldy | B27G 19/04 | 30/391 |
| 2,737,985 | A * | 3/1956 | Utz | B27G 19/04 | 30/391 |
| 3,787,973 | A * | 1/1974 | Beisch | B27G 19/04 | 30/391 |
| 4,672,746 | A * | 6/1987 | Zeilenga | B27G 19/04 | 30/391 |
| 5,235,752 | A | 8/1993 | Sauerwein et al. | | |
| 5,406,710 | A * | 4/1995 | Zaiser | B27G 19/08 | 30/390 |
| 8,413,340 | B2 * | 4/2013 | Orlowski | B27G 19/04 | 30/391 |
| 2002/0170399 | A1 | 11/2002 | Gass et al. | | |
| 2007/0151433 | A1 | 7/2007 | Gass et al. | | |
| 2008/0168667 | A1 * | 7/2008 | Spinato | B23D 45/16 | 30/391 |
| 2012/0055302 | A1 * | 3/2012 | Tanaka | B27G 19/08 | 83/102.1 |
| 2012/0067186 | A1 * | 3/2012 | Keller | B27G 19/02 | 83/522.12 |
| 2019/0381688 | A1 * | 12/2019 | Wiker | B27G 19/08 | |

FOREIGN PATENT DOCUMENTS

| | | | |
|---|---|---|---|
| DE | 295 10 061 | U1 | 10/1996 |
| DE | 10 2009 060 088 | A1 | 8/2010 |
| EP | 0 012 404 | A1 | 6/1980 |
| EP | 2 422 909 | A1 | 2/2012 |
| WO | 2009/120538 | A1 | 10/2009 |

* cited by examiner

CIRCULAR SAW, IN PARTICULAR HAND-HELD CIRCULAR SAW

This application is a 35 U.S.C. § 371 National Stage Application of PCT/EP2018/050494, filed on Jan. 10, 2018, which claims the benefit of priority to Serial No. DE 10 2017 201 493.8, filed on Jan. 31, 2017 in Germany, the disclosures of which are incorporated herein by reference in their entirety.

BACKGROUND

The present disclosure relates to a circular saw, in particular a hand-held circular saw, having a housing and a drive unit, at least some sections of which are arranged in the housing and to which a tool holder for an exchangeable saw blade is assigned, the drive unit being designed to rotationally drive the exchangeable saw blade about an associated axis of rotation.

The prior art discloses such a circular saw, designed as a hand-held circular saw, which has a housing and a drive unit, of which some sections are arranged in the housing. Here, the drive unit is assigned a tool holder for an exchangeable saw blade, and the drive unit is designed to rotationally drive the exchangeable saw blade about an associated axis of rotation. In order to protect a user of the circular saw against injury because of contact with the cutting point, the circular saw has a pendulum protective hood. Said pendulum protective hood encloses the saw blade and is rotatably mounted about a saw blade centre point. During the sawing operation, the pendulum protective hood is urged into the housing of the circular saw, so that the saw blade is exposed and thus an injury can arise because of contact between the cutting point and the user.

SUMMARY

The present disclosure provides a circular saw, in particular a hand-held circular saw, having a housing and a drive unit, at least some sections of which are arranged in the housing and to which a tool holder for an exchangeable saw blade is assigned. The drive unit is designed to rotationally drive the exchangeable saw blade about an associated axis of rotation. The exchangeable saw blade is assigned a protective wedge, which is mounted in the housing such that it can rotate about the associated axis of rotation and encloses a cutting point of the exchangeable saw blade, at least during a sawing operation, in such a way that contact with the cutting point can at least substantially be prevented.

The disclosure thus permits the provision of a circular saw, in particular a hand-held circular saw, in which, by means of the protective wedge, even during a sawing operation, a corresponding risk of injury because of contact with the cutting point of the saw blade can at least largely be reduced. Thus, the provision of a safe and reliable circular saw can be made possible.

The protective wedge preferably has a thickness which corresponds at most to a thickness of the exchangeable saw blade. Thus, during a sawing operation, the protective wedge can be guided in a sawing groove formed by the saw blade, and thus enclose the saw blade even during a sawing operation and in this way at least approximately prevent contact with the cutting point of the saw blade.

Preferably, the protective wedge for enclosing the cutting point of the exchangeable saw blade is spring-loaded. Thus, an arrangement of the protective wedge in which the cutting point of the saw blade is always maximally enclosed can be made possible.

According to one embodiment, the protective wedge is spring-loaded in such a way that the cutting point of the exchangeable saw blade is maximally enclosed. Thus, contact with the cutting point can be at least substantially prevented safely and reliably even during a sawing operation.

Preferably, the protective wedge is rotatably mounted at an end of the housing that faces away from a working area of the circular saw. Thus, maximum enclosure of the saw blade can be made possible in a simple and uncomplicated manner.

The protective wedge is preferably formed in the manner of a semicircular ring. Thus, a suitable protective wedge which can be arranged pivotably about the axis of rotation of the drive unit can be provided in a simple way.

According to one embodiment, the protective wedge exposes the exchangeable saw blade at most in an angular range of 90° during a sawing operation. Thus, with a maximum cutting depth, maximum enclosure of the saw blade can be made possible.

Preferably, a touch sensor is assigned to the protective wedge. Thus, a contact safeguard in the area of a working area of the circular saw can be made possible in a safe and uncomplicated manner.

According to one embodiment, a safety device is provided, which is designed to permit safe operation of the circular saw. In this case, the safety device can be provided in addition to the protective wedge or alternatively thereto. Thus, the provision of a safe and reliable circular saw can be made possible in a simple way.

The safety device preferably has a clutch for uncoupling the drive unit from the exchangeable saw blade. Thus, in the event of detection of a contact, rapid braking of the saw blade and a comparatively short braking time can be made possible.

The safety device preferably has a saw blade brake. Thus, braking of the saw blade in the event of detection of a contact can be made possible in a simple way.

Preferably, the saw blade brake is formed in the manner of a disc brake with at least one brake disc, or in the manner of a pyro brake with a pyro and a blocking element. Thus a suitable saw blade brake can be provided in a simple and uncomplicated manner.

According to one embodiment, the safety device has a linear actuator for the linear displacement of the exchangeable saw blade. Thus, in the event of detection of a contact, the saw blade can be loaded into the housing, so that the contact can be suppressed quickly.

BRIEF DESCRIPTION OF THE DRAWINGS

The disclosure is explained in more detail in the following description by using exemplary embodiments illustrated in the drawings, in which.

DETAILED DESCRIPTION

Figure 1:
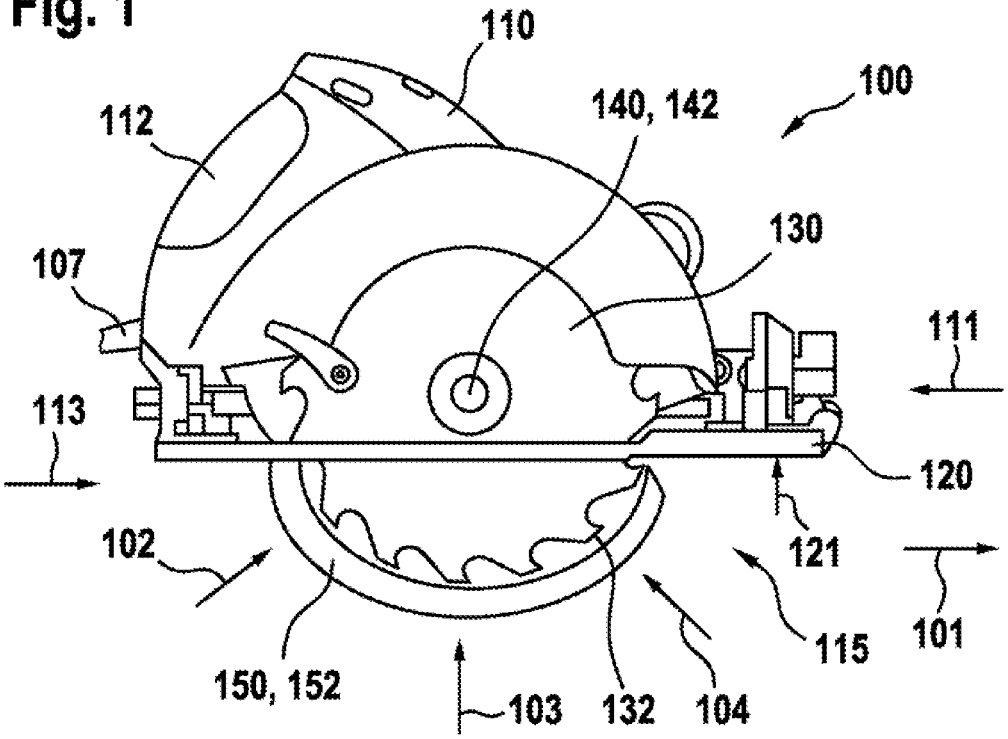
FIG. 1 shows a side view of a hand-held machine tool with a protective wedge in a protective position.

FIG. 1 shows a hand-held machine tool 100, formed as a circular saw by way of example, with a housing 110, which preferably forms a handle 112. The circular saw 100 is preferably assigned a drive unit (710 in FIG. 7), of which at least some sections are arranged in the housing 110. The drive unit (710 in FIG. 7) is preferably used to drive a tool holder 140 for an exchangeable saw blade 130. Here, the drive unit (710 in FIG. 7) is in particular designed for the rotational drive of the exchangeable saw blade 130 about an associated axis of rotation 142. The saw blade 130 is preferably formed as a circular saw blade with a cutting point 132.

Preferably, the circular saw 100 is connected mechanically and electrically to a power line 107 for mains-dependent power supply but, in addition or alternatively, can be provided with a battery pack for mains-independent power supply. By way of illustration, the circular saw 100 is formed in the manner of a hand-held circular saw and will therefore also be designated below as the "hand-held circular saw 100", but can also be formed as a table circular saw, plunge-cut saw or any other desired electrical tool having a saw blade.

Preferably, the hand-held circular saw 100, preferably its housing 110, has a first and second end 111, 113, wherein the hand-held circular saw 100 is provided for sawing in a working direction 101. Here, a corresponding working area 115 is preferably formed at the first end 111 and in the working direction 101 in front of the saw blade 130. Moreover, the hand-held circular saw 100 is preferably provided with a guide plate 120 which, for example, can be guided on an upper side (202 in FIG. 2) of a workpiece (210 in FIG. 2) to be machined. Here, the guide plate 120 has an underside 121, by way of illustration facing away from the drive unit (710 in FIG. 7), with which the hand-held circular saw 100, can for example, be guided on the upper side (202 in FIG. 2) of the workpiece (210 in FIG. 2) to be machined.

Preferably, the saw blade 130 is assigned a protective wedge 150, which is preferably mounted in or on the housing 110 such that it can rotate about the associated axis of rotation 142. Here, during a sawing operation, the protective wedge 150 preferably encloses a portion of the saw blade 130 extending from the underside 204 of the workpiece 210, in such a way that contact with the portion of the saw blade by the user of the hand-held circular saw 100 is at least substantially prevented. In FIG. 1, the cutting point 132 is completely enclosed by the protective wedge 150, by way of illustration, so that contact of the cutting point 132 in the region of the first end 111, the second end 113 and/or from a side for example facing the underside 121 of the guide plate 120 or, by way of illustration, in the direction of arrows 102, 103, 104 is prevented.

Preferably, the protective wedge 150 is rotatably mounted at the first end 111 or at the end 113 of the housing 110 that faces away from the working area 115. Preferably, the protective wedge 150 is formed in the manner of a semi-circular ring 152. The protective wedge 150 is preferably spring-loaded to enclose the cutting point 132 of the saw blade 130. Preferably, the protective wedge 150 is spring-loaded in such a way that the cutting point 132 is enclosed maximally. Here, the protective wedge 150 preferably has a thickness which corresponds at most to a thickness of the saw blade 130, so that during a sawing operation the protective wedge 150 can be arranged and guided in a corresponding sawing groove formed by the saw blade 130. During a sawing operation, the protective wedge 150 preferably exposes the saw blade 130 at most by an angular range of 90°. This is preferably carried out during a sawing operation with a maximum cutting depth of the saw blade 130.

Furthermore, the hand-held circular saw 100 preferably also has an optional pendulum protective hood. An appropriate pendulum protective hood is sufficiently well known from the prior art, for which reason, for the purpose of simplicity and brevity of the description, a detailed description of the optional pendulum protective hood is omitted.

Figure 2:
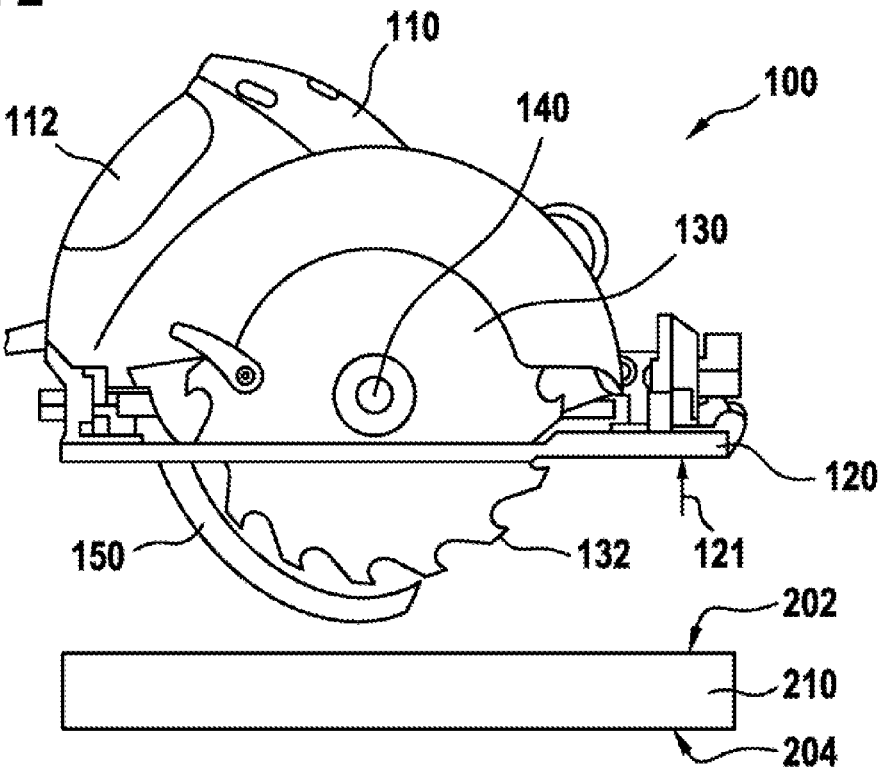
FIG. 2 shows a side view of the hand-held machine tool from FIG. 1 with the protective wedge in a maximum opened position.

FIG. 2 shows the hand-held circular saw 100 from FIG. 1 with the protective wedge 150 in an opened position, in which the protective wedge 150 encloses the saw blade 130 only partly. By way of example, here FIG. 2 illustrates a position which preferably corresponds to a maximum opened or retracted position of the protective wedge 150. However, it is pointed out that, depending on the application, the maximum opened position of the protective wedge 150 can also expose a larger area of the saw blade 130, for example in the case of a plunge-cut saw, in which the protective wedge 150 can advantageously be rotated in completely.

By way of illustration, in FIG. 2 the hand-held circular saw 100 is arranged outside the workpiece 210. In FIG. 2, the workpiece 210 is, for example, rectangular and has an upper and lower side 202, 204, the hand-held circular saw 100 being arranged above the upper side 202 by way of illustration. Such an arrangement of the hand-held circular saw 100 above the workpiece 210 can be present, for example, before or after a sawing operation or during a sawing operation after what is known as a "kickback", in which the hand-held circular saw 100 is catapulted out of the workpiece 210.

Figure 3:
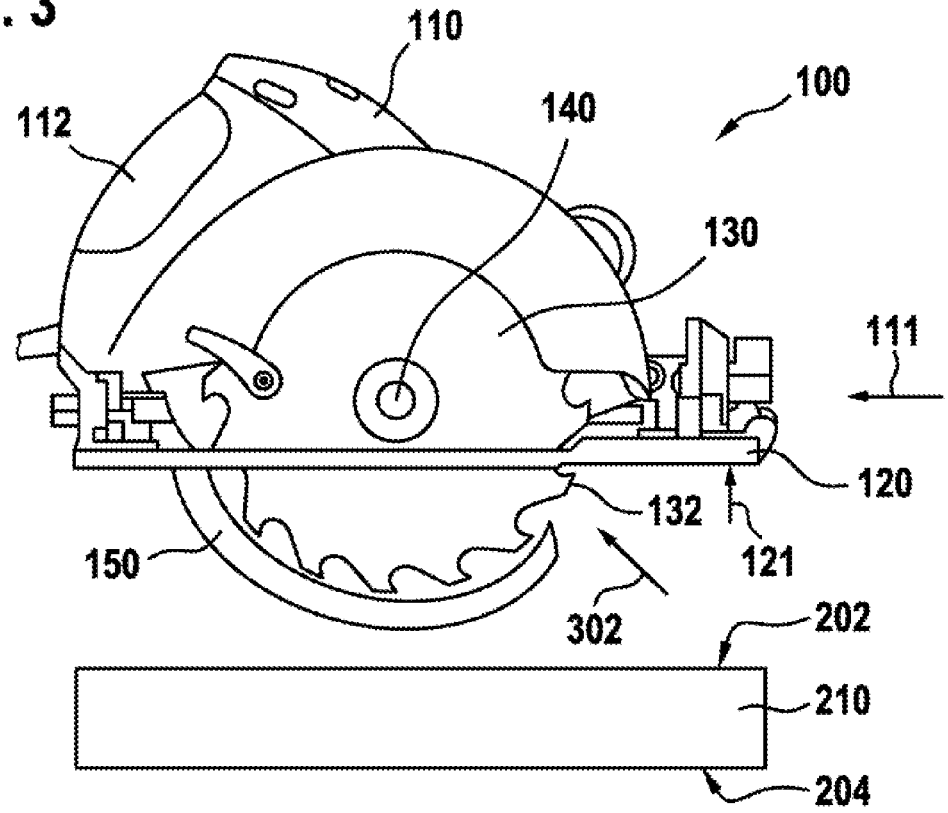
FIG. 3 shows a side view of the hand-held machine tool from FIG. 2 with the protective wedge in a largely closed position.

FIG. 3 shows the hand-held circular saw 100 from FIG. 2 in which the cutting point 132 of the saw blade 130 is enclosed by the spring-loaded protective wedge 150 in a greater angular range as compared with FIG. 2 or is almost completely enclosed. Here, in FIG. 3, the cutting point 132 is only exposed in an angular range of approximately 25° in an area 302 facing the first end 111. Since the spring-loaded protective wedge 150 preferably has a comparatively low mass moment of inertia, a comparatively rapid enclosure of the cutting point 132 can thus be made possible.

Figure 4:
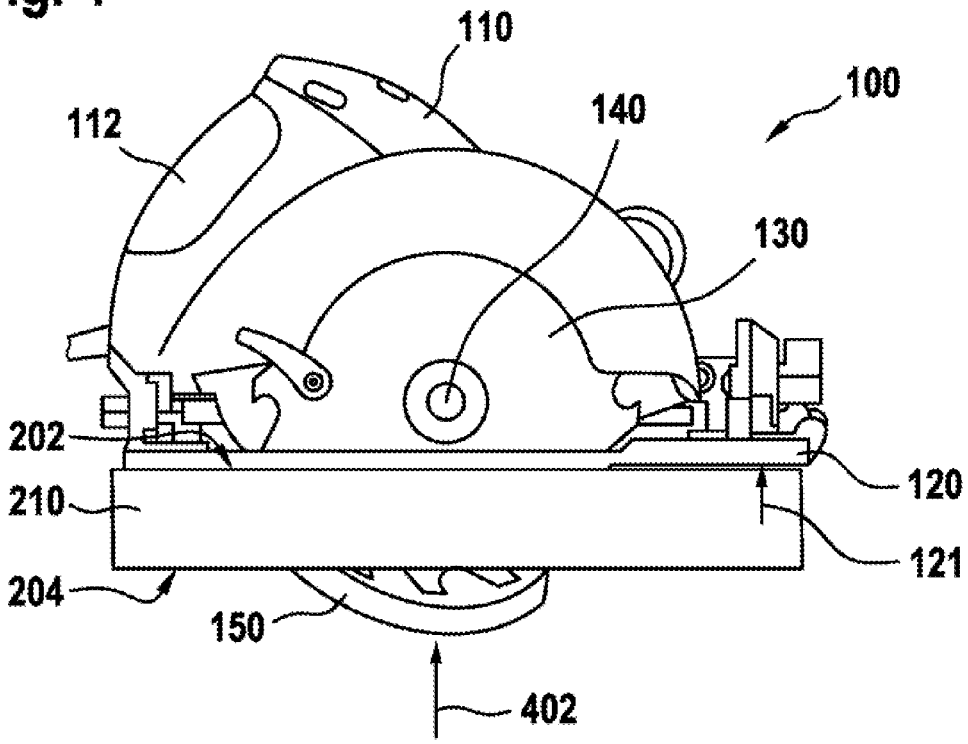
FIG. 4 shows a side view of the hand-held machine tool from FIG. 1 to FIG. 3 during a sawing operation in a workpiece.

FIG. 4 shows the hand-held circular saw 100 from FIG. 1 to FIG. 3 in a preferred working position during a sawing operation in the workpiece 210, in which the guide plate 120 rests and is guided with its underside 121 on the upper side 202 of the workpiece 210. Here, the protective wedge 150 encloses the cutting point 132 of the saw blade 130 in such a way that contact of a user with the saw blade 130 or the cutting point 132 in the region of the underside 204 of the workpiece 210 or in the direction of an arrow 402 is effectively prevented.

Figure 5:
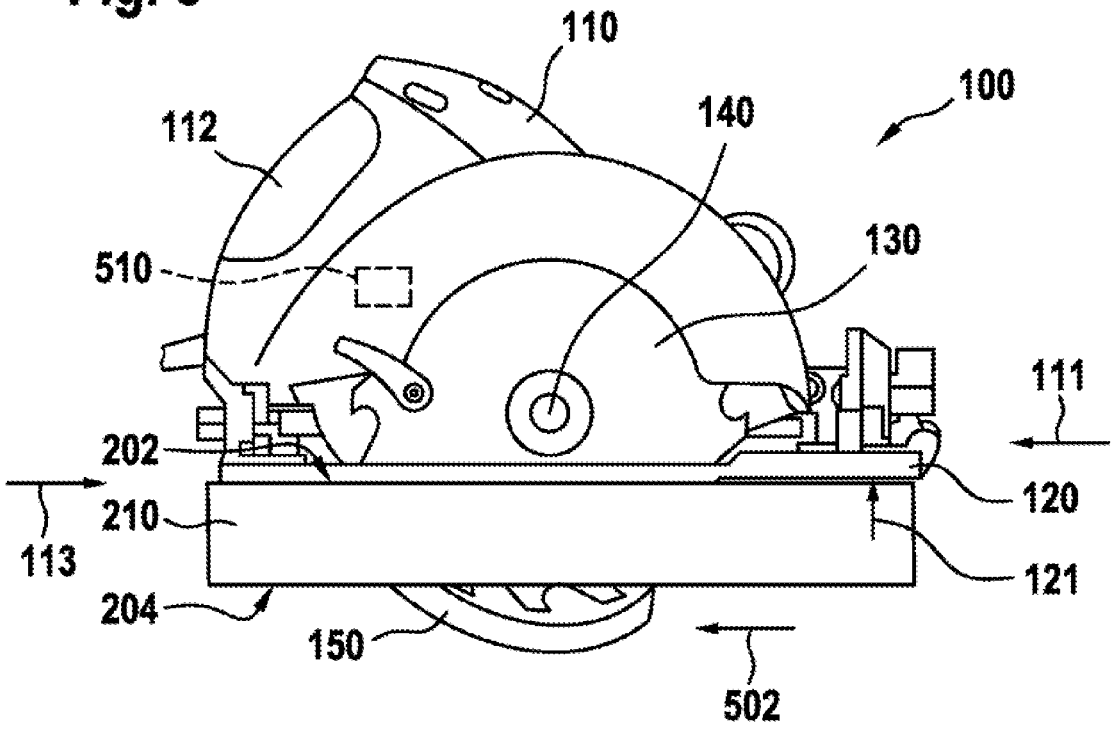
FIG. 5 shows a side view of the hand-held machine tool from FIG. 4 during a sawing operation with loading of the protective wedge.

FIG. 5 shows the hand-held circular saw 100 from FIG. 4 in the working position, in which, by way of example, the first end 111 is loaded in the direction of the second end 113 or the protective wedge 150 is loaded into the housing 110 or in the direction of an arrow 502. Such a loading can be exerted, for example, by a body part of a user, for example their hand. To protect a user during such a loading, a touch sensor 510 is preferably assigned to the protective wedge 150.

By way of illustration, in FIG. 5 the touch sensor 510 is arranged in the housing 110 but can also be arranged directly on the protective wedge 150 or any other desired point of the hand-held circular saw 100. Preferably, the touch sensor 510 detects a contact between the protective wedge 150 and another object, for example the hand of a user of the hand-held circular saw 100. Furthermore, the touch sensor 510 can also cover a detection of the protective wedge 150 with a protective device specifically designed for this purpose, for example a glove or the like that can be detected by the touch sensor 510. Here, the touch sensor 510 is preferably designed to trigger a mechanism which preferably blocks the protective wedge 150 in the event of a detection.

Figure 6:
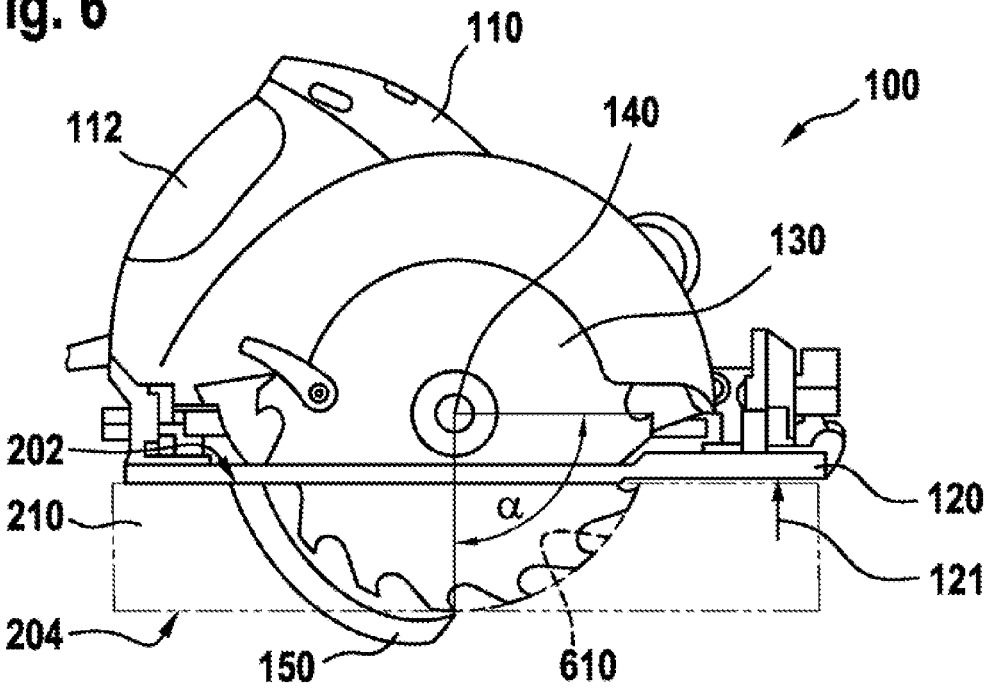
FIG. 6 shows a side view of the hand-held machine tool from FIG. 4 and FIG. 5 during a sawing operation in a workpiece, with the protective wedge in a maximum opened position.

FIG. 6 shows the hand-held circular saw 100 from FIG. 1 to FIG. 5 in the working position at a maximum cutting depth. Here, FIG. 6 illustrates a cutting line 610 of the saw blade 130 in the workpiece 210. Preferably, at maximum cutting depth, the protective wedge 150 is arranged in its preferably maximum opened position and preferably exposed by an angle $\alpha$ of preferably at most 90°. As described above, the maximum opened position of the protective wedge 150 can also be greater or lesser than 90°.

Figure 7:
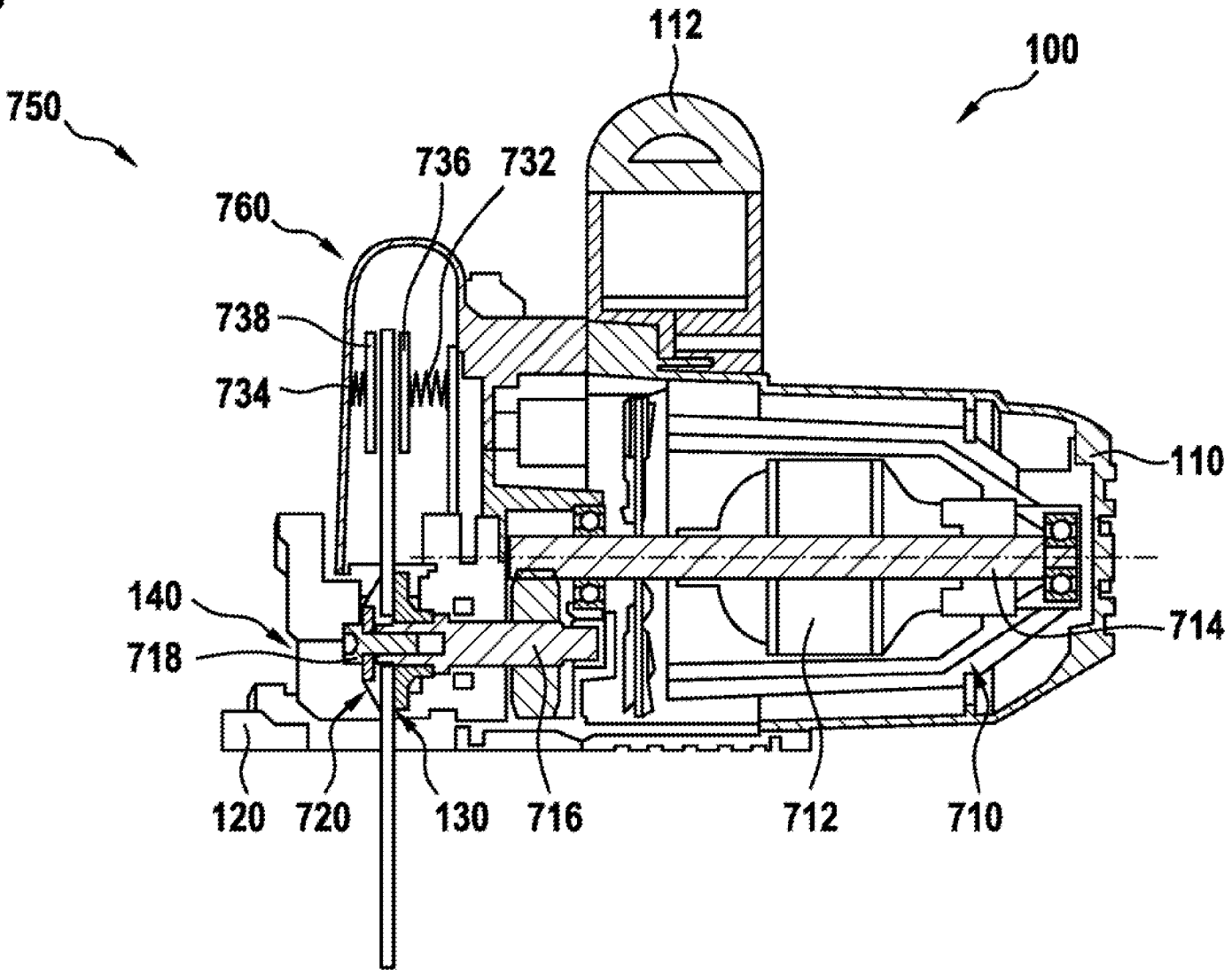
FIG. 7 shows a sectional view of the hand-held machine tool from FIG. 1 to FIG. 6 with a saw blade brake according to one embodiment.

FIG. 7 shows the exemplary hand-held circular saw 100 from FIG. 1 to FIG. 6 and illustrates a drive unit 710 of the hand-held circular saw 100. The drive unit 710 is preferably assigned a drive motor 712 with a drive shaft 714. The drive shaft 714 is designed to drive an output shaft 716 assigned to the tool holder 140. The saw blade 130 is, by way of illustration, preferably detachably arranged on the tool holder 140 by a fixing means 718. The fixing means 718 is preferably formed as a screw.

According to one embodiment, the hand-held circular saw 100 has a safety device 750 which is designed to permit safe operation of the hand-held circular saw 100. The safety device 750 is preferably assigned to the touch sensor 510 from FIG. 5, wherein the touch sensor 510 in this case is preferably designed to activate the safety device 750 in the event of a detection of a contact, for example by a body part of the user of the hand-held circular saw 100.

However, it is pointed out that the safety device 750 does not necessarily have to be assigned to the touch sensor 510 from FIG. 5 but can also be used instead of the protective wedge 150 and the touch sensor 510 from FIG. 5. Furthermore, the safety device 750 can also be assigned a separate touch sensor which, for example, can be arranged on the saw blade 130 or assigned thereto. In an analogous way, each of the embodiments of the safety device 750 described below can be used separately or in combination with one or more other embodiments of the safety device 750.

The safety device 750 according to FIG. 7 preferably has a brake 760, formed as a saw blade brake, for braking the saw blade 130, which brake is preferably triggered in the event of an activation of the safety device 750. The saw blade brake 760 is preferably formed in the manner of a disc brake having at least one, by way of illustration two, brake discs 736, 738. Here, the two brake discs 736, 738 are, by way of example, arranged at the side of the saw blade 130, wherein the brake disc 736 in FIG. 7 is by way of illustration arranged on the right of the saw blade 130 and the brake disc 738 is by way of illustration arranged on the left of the saw blade 130. Preferably, the two brake discs 736, 738 are each spring-loaded via a spring element 732, 734. Here, a mechanism is preferably provided which is designed to hold the brake discs 736, 738 and/or the spring elements 732, 734 back during a sawing operation, so that the saw blade 130 can rotate in an unimpeded or unbraked manner. The mechanism and/or the spring elements 732, 734 preferably have a hook element to hold the brake discs 736, 738 back. In the event that the saw blade brake 760 is triggered by the touch sensor 510 or in the event of a contact, an actuator preferably releases the hook element and the spring elements 732, 734 loads the brake discs 736, 738 on the saw blade 130.

It is pointed out that the configuration of the mechanism for triggering the saw blade brake 760 has a merely exemplary character and is not to be seen as restricting the present disclosure. Thus, the mechanism can be formed in a different way, for example as a combination with a spring element and a fusible wire. Here, for example, during the sawing operation the spring element can be held back by a wire which is burnt through in the event of a detection of a contact. As an alternative to this, the fusible wire can also be formed in the manner of a wire made of a shape-memory alloy.

However, the present disclosure is not restricted to a saw blade brake 760 which acts directly on the saw blade 130. Thus, for example, a braking element, e.g. a brake disc, can act directly on the tool holder 140. Preferably, the saw blade brake 760 is arranged as far as possible at the end of the drive unit 710, so that as few rotating parts as possible have to be braked in order to bring the saw blade 130 to a standstill. As a result, a braking time of the saw blade 130 can be shortened.

Furthermore, the brake 760 can alternatively also be formed as a coil spring brake and/or wedge brake. Here, a wedge brake has at least one wedge which brakes the saw blade 130. Here, self-energizing can be achieved by the at least one wedge and a rotational movement of the saw blade 130. As a result, a comparatively high braking force can be achieved with a comparatively small spring force. Preferably, the brake can also be formed as an exchangeable module, which means that simple handling of the saw blade brake 760 can be made possible. For example, a wedge brake which clamps with a comparatively high force, the at least one wedge being clamped between the saw blade 130 and a guide of the wedge, can be exchanged in a simple and uncomplicated manner and preferably reset or unclamped from outside.

Moreover, the safety device 750 preferably has a clutch 720 for uncoupling the drive unit 710 from the saw blade 130, so that only the saw blade 130 has to be braked. Thus, the saw blade brake 760 preferably has to operate only counter to a comparatively low torque of the drive motor 712 and merely has to apply a torque to overcome the mass moment of inertia of the hand-held circular saw 100 in order to brake the hand-held circular saw 100 or the saw blade 130. As a result, a comparatively short braking time can be implemented. Preferably, the clutch 720 is assigned to the tool holder 140, so that only a necessary torque for normal operation or for sawing operation has to be transmitted to the saw blade 130.

However, it is pointed out that the configuration of the tool holder 140 with the clutch 720 has a merely exemplary character and is not to be seen as restricting the disclosure. Thus, the clutch 720 can also be formed as a separate clutch, which is preferably arranged in the region of the saw blade 130. Here, the separate clutch is preferably formed in an analogous way to the clutch 720 to uncouple the saw blade 130 from the drive unit 710. Preferably, a relevant mass moment of inertia to be braked is to be reduced in such a way that preferably as few parts as possible, particularly preferably only the saw blade 130, can be braked as quickly as possible.

Figure 8:
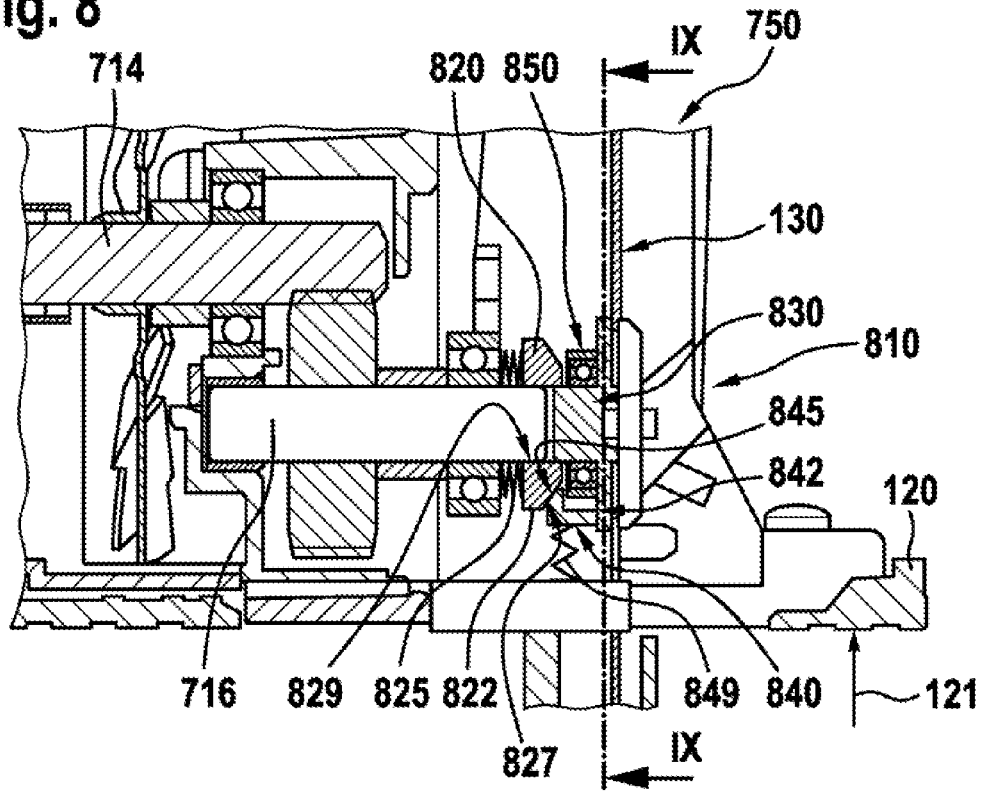
FIG. 8 shows a sectional view of the hand-held machine tool from FIG. 1 to FIG. 7 with a linear actuator.

FIG. 8 shows the hand-held circular saw 100 from FIG. 1 to FIG. 7 with the safety device 750 which, alternatively or additionally, is assigned a linear actuator 810. As described above, the safety device 750 is preferably assigned to the touch sensor 510 from FIG. 5, wherein the touch sensor 510 is preferably designed to activate the safety device 750 in the event of a detection of a contact, for example by a body part of a user of the hand-held circular saw 100. Here, the safety device 750 activates the linear actuator 810, which is designed to move or to displace the saw blade 130 linearly.

Preferably, the linear actuator 810 has a clutch 820, which is designed to uncouple the drive unit 710 from FIG. 7 from the saw blade 130. In the event of an activation of the safety device 750, the clutch 820 is released, the saw blade 130 being uncoupled from the drive unit 710 and the linear actuator 810 preferably loading or displacing the saw blade 130 linearly into the housing 110 of the hand-held circular saw 100. Thus, in particular in the event of a contact by a body part of a user of the hand-held circular saw 100, a corresponding contact is cancelled very quickly, so that at most only comparatively small cuts or injuries to the body part can arise.

The clutch 820 is preferably arranged between the output shaft 716 and an intermediate shaft 830. During a sawing operation, the clutch 820 is preferably spring-loaded against the intermediate shaft 830 via at least one spring element 825. Here, a torque and a rotational speed are transmitted from the output shaft 716 to the intermediate shaft 830, preferably via the clutch 820, and to the saw blade 130 by the intermediate shaft 830. The intermediate shaft 830 is preferably mounted in a bearing housing 850.

Preferably, the clutch 820 has a cylindrical base body 822 which, for example, has a passage opening 829 to be arranged on the output shaft 716 and/or the intermediate shaft 830. On its side facing the intermediate shaft 830, the base body 822 preferably has a coupling section 827. By way of illustration and example, the coupling section 827 is formed as a bevel.

In the event of an activation of the safety device 750, the clutch 820 is preferably uncoupled first. In the process, a triggering element 840 loaded by at least one spring element 849 is preferably released. By way of illustration, the triggering element 840 is loaded upward by the spring element 849. Preferably, the spring element 849 is arranged on the guide plate 120 of the hand-held circular saw 100. The triggering element 840 is preferably assigned a surface 845 corresponding with the coupling section 827. As a result of the illustrated vertical movement of the triggering element 840, the surface 845 preferably forces the clutch 820 against the at least one spring element 825 or, by way of illustration, to the left. Thus, the clutch 820 is uncoupled and the output shaft 716 is separated from the intermediate shaft 830. Here, an upper edge 842 of the triggering element 840, facing the bearing housing 850, preferably loads the bearing housing 850 having the intermediate shaft 830 upward or linearly upward, by way of illustration.

Figure 9:
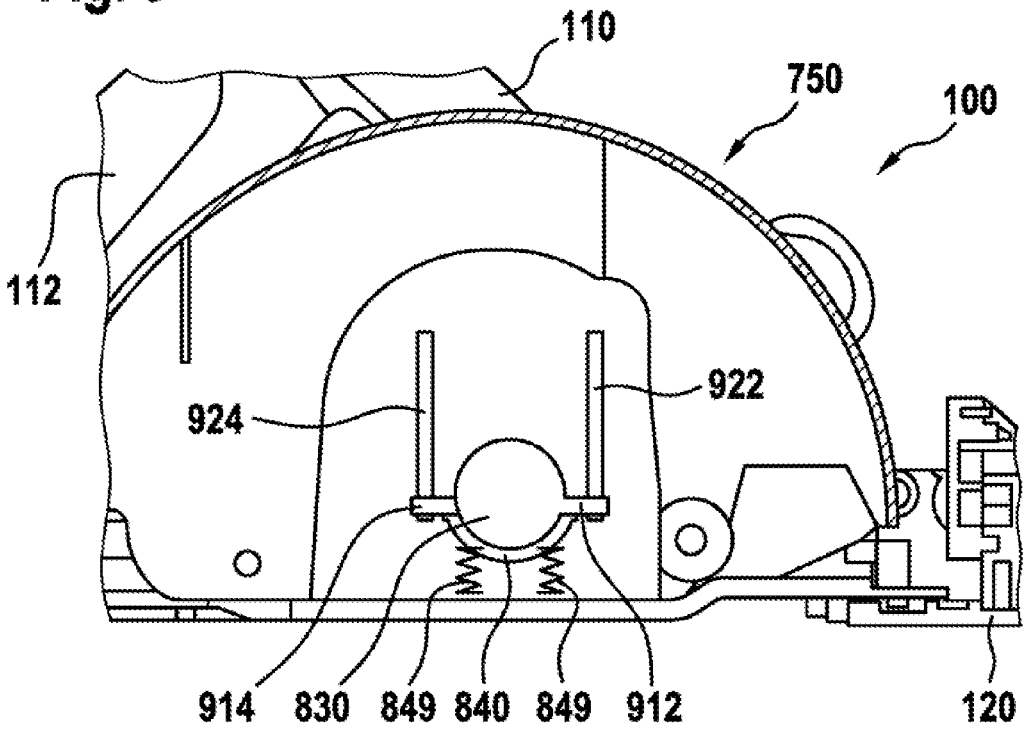
FIG. 9 shows a sectional view of the hand-held machine tool from FIG. 1 to FIG. 7 with the linear actuator from FIG. 8, seen in the direction of arrows IX from FIG. 8.

FIG. 9 shows the hand-held circular saw 100 from FIG. 8 with the linear actuator 810. Here, FIG. 9 illustrates the linear actuator 810, which is preferably assigned two guide rails 922, 924, on which the triggering element 840 is linearly movably arranged. The two guide rails 922, 924 are preferably arranged on the housing 110. For the linear movement of the intermediate shaft 830, the bearing housing 850 preferably has two lateral guide elements 912, 914, which are preferably mounted on the guide rails 922, 924. Furthermore, FIG. 9 illustrates the triggering element 840 loaded by at least one spring element, by way of illustration via two spring elements 849, which is designed to load or to displace the bearing housing 850 linearly when the clutch 820 is uncoupled.

Figure 10:
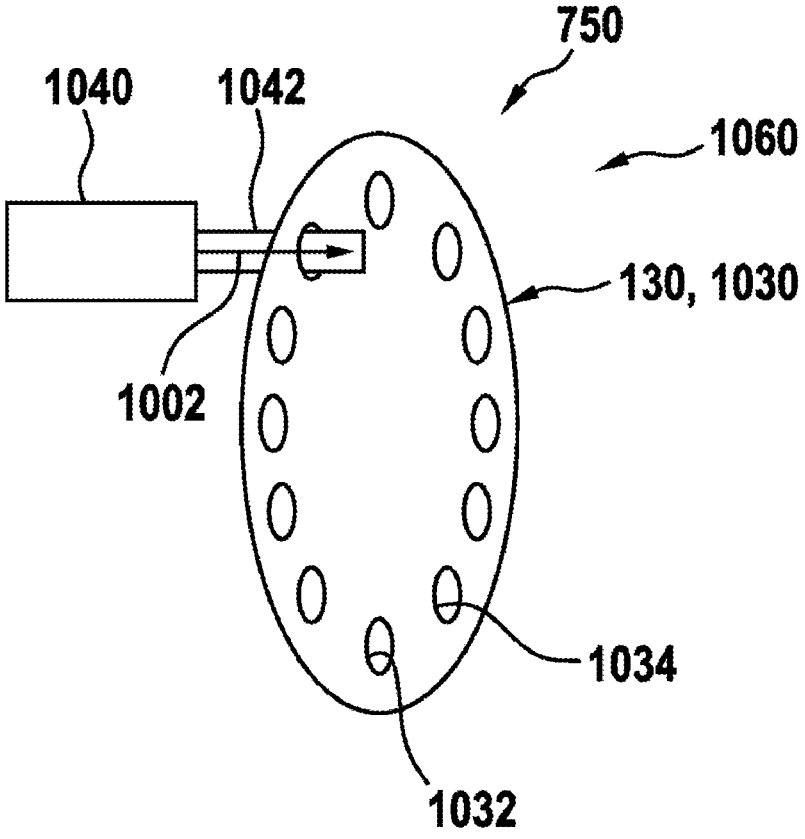
FIG. 10 shows a perspective view of a saw blade brake assigned to the hand-held machine tool from FIG. 1 to FIG. 7 according to a further embodiment.

FIG. 10 shows an alternative brake 1060 assigned to the safety device 750. The brake 1060 is preferably designed as a saw blade brake, wherein the saw blade brake 1060 is preferably formed in the manner of a pyro brake having a pyro 1040 and a blocking element 1042. For this purpose, the saw blade 130 preferably has in the circumferential direction a multiplicity 1030 of cut-outs 1032, 1034 into which the blocking element 1042 can be moved abruptly in the direction of an arrow 1002 in the event of an activation of the safety device 750 or the pyro brake 1060. Here, the blocking element 1042 can also be loaded by a spring element or by a combination of a spring element and the pyro 1040.

The invention claimed is:

1. A circular saw for cutting a workpiece, comprising:

a housing;

a tool holder supported by the housing and operably connected to an exchangeable saw blade;

a drive unit at least partially arranged in the housing and operably connected to the tool holder, the drive unit configured to rotationally drive the tool holder and the exchangeable saw blade about an associated axis of rotation; and a protective wedge assigned to the exchangeable saw blade and rotatably mounted on the housing such that the protective wedge is rotatable about the associated axis of rotation, the protective wedge configured to enclose at least a portion of the exchangeable saw blade, and the protective wedge guided in a sawing groove formed by the saw blade in the workpiece during a sawing operation of the workpiece, in such a way that contact with the portion of the exchangeable saw blade is at least substantially prevented, wherein the protective wedge is rotatable about the associated axis of rotation to expose the exchangeable saw blade by at most an angular range of 90°.

2. The circular saw as claimed in claim 1, wherein the protective wedge has a wedge thickness which is less than or equal to a blade thickness of the exchangeable saw blade.

3. The circular saw as claimed in claim 1, wherein the protective wedge is spring-loaded.

4. The circular saw as claimed in claim 3, wherein the protective wedge is spring-loaded in a working direction of the circular saw.

5. The circular saw as claimed in claim 1, wherein the protective wedge is rotatably mounted at an end of the housing that faces away from a working area of the circular saw.

6. The circular saw as claimed in claim 1, wherein the protective wedge is formed as a semicircular ring.

7. The circular saw as claimed in claim 1, further comprising:

a safety device configured to permit safe operation of the circular saw.

8. The circular saw as claimed in claim 7, wherein the safety device has a clutch configured to uncouple the drive unit from the exchangeable saw blade.

9. The circular saw as claimed in claim 7, wherein the safety device has a saw blade brake.

10. The circular saw as claimed in claim 9, wherein the saw blade brake includes one of (i) a disc brake with at least one brake disc and (ii) a pyro brake with a pyro and a blocking element.

11. The circular saw as claimed in claim 7, wherein the safety device has a linear actuator configured to linearly displace the exchangeable saw blade.

12. The circular saw as claimed in claim 1, wherein the circular saw is a hand-held circular saw.

13. A circular saw for cutting a workpiece, comprising:

a housing;

a tool holder supported by the housing and operably connected to an exchangeable saw blade;

a drive unit at least partially arranged in the housing and operably connected to the tool holder, the drive unit configured to rotationally drive the tool holder and the exchangeable saw blade about an associated axis of rotation; and a protective wedge assigned to the exchangeable saw blade and rotatably mounted on the housing such that the protective wedge is rotatable about the associated axis of rotation, the protective wedge configured to enclose at least a portion of the exchangeable saw blade, and the protective wedge guided in a sawing groove formed by the saw blade in the workpiece during a sawing operation of the workpiece, in such a way that contact with the portion of the exchangeable saw blade is at least substantially prevented, wherein the protective wedge is assigned a touch sensor configured to detect a contact between the protective wedge and an object, and wherein the touch sensor is configured to trigger a mechanism for blocking the protective wedge in the event of a detection.

14. The circular saw as claimed in claim 13, wherein the touch sensor is operatively connected to the protective wedge.

* * * * *